United States Patent [19]

Yokosuka et al.

[11] Patent Number: 4,968,169

[45] Date of Patent: Nov. 6, 1990

[54] PENPOINT ASSEMBLY AND WRITING INSTRUMENT EMPLOYING THE SAME

[75] Inventors: Takehiko Yokosuka; Osami Yamauchi, both of Aichi, Japan

[73] Assignee: Pilot Ink Co., Ltd., Aichi, Japan

[21] Appl. No.: 209,815

[22] Filed: Jun. 22, 1988

[30] Foreign Application Priority Data

Jun. 26, 1987 [JP] Japan ..... 62-98839[U]
Aug. 6, 1987 [JP] Japan ..... 62-120894[U]

[51] Int. Cl.[5] ..... B43K 5/00; B43K 8/06
[52] U.S. Cl. ..... 401/227; 401/198
[58] Field of Search ..... 401/198, 223, 199, 224, 401/225, 227

[56] References Cited

U.S. PATENT DOCUMENTS

| | | | |
|---|---|---|---|
| 546,850 | 9/1895 | Lepper | 401/221 X |
| 2,921,558 | 1/1960 | Von Platen | 401/224 |
| 3,292,596 | 12/1966 | Ishida | 401/251 |
| 3,340,560 | 9/1967 | Nakata | 401/198 |
| 3,361,516 | 1/1968 | Rigondaud | 401/199 X |
| 4,302,120 | 11/1981 | Ligouri | 401/198 |

FOREIGN PATENT DOCUMENTS

| | | | |
|---|---|---|---|
| 6209342 | 1/1987 | European Pat. Off. | 401/231 |
| 6164482 | 5/1985 | Japan | 401/223 |

*Primary Examiner*—Richard J. Apley
*Assistant Examiner*—D. F. Crosby
*Attorney, Agent, or Firm*—Sughrue, Mion, Zinn, Macpeak & Seas

[57] ABSTRACT

A penpoint assembly includes a penpoint which is made of a metal plate cut off at both side edges to form a taper toward the writing tip. A slit is provided extending from the front end of the writing tip to the vicinity of the rear end of the writing tip along the center line of the penpoint. The penpoint is bent at the writing tip to form small bent projections at both sides of the slit, the bent portion surrounding a small space. An ink guide core extends under the slit and communicates at the tapered portion of the ink guide core with the slit. A support member supports the ink guide core and penpoint. A writing instrument includes the penpoint assembly, the support member being integrally formed with an ink flow regulating portion, so that ink in an ink storage member in the rear portion of a penholder is guided to the writing tip through the ink guide core.

4 Claims, 2 Drawing Sheets

PENPOINT ASSEMBLY AND WRITING INSTRUMENT EMPLOYING THE SAME

BACKGROUND OF THE INVENTION

The present invention relates to a penpoint assembly and a writing instrument employing the same, and particularly relates to a penpoint assembly comprising a penpoint made of a metal plate cut off at both the side edges thereof as a taper toward the writing tip of the penpoint and having a slit along the center line of the penpoint, an ink guide core through which ink from an ink storage means is guided to the slit, and a support member for supporting the ink guide core, and to a writing instrument employing the penpoint assembly and constituted so that the ink is guided to the writing tip of the penpoint through an ink flow regulating portion.

A conventional penpoint assembly comprising a penpoint made of a metal plate having a slit along the center line of the penpoint, a support member and an ink guide core interposed between the penpoint and the support member, and a conventional writing instrument employing the penpoint assembly were disclosed in the European Patent Application (OPI) No. 209,342A (the term "OPI" as used herein means an "unexamined published application"). The slit of the metal plate constituting the penpoint extends along the axial direction of the penpoint assembly similarly to a fountain pen. Ink in the ink guide core extending in tight contact with the penpoint under the slit in the axial direction of the penpoint assembly is introduced into the slit so that the ink flows out from the writing tip of the penpoint. We studied the ink discharge mechanism constituted by the penpoint and the ink guide core in combination, the machinability or workability of the penpoint and so forth. As a result, we obtained some knowledge about them and found a number of problems in them, as mentioned from now on. It is substantially inevitable to perform shearing to make the slit in the metal plate, especially when the metal plate is a thin stainless steel plate. As for the shearing, the mutual non-coincidence of the sheared portions of the metal plate at the writing tip of the penpoint increases in proportion to the length of the slit. The increase in the length of the slit does not contribute to improving the outflow of the ink. The outflow of the ink depends on only a few millimeters of the length of the slit from the writing tip of the penpoint. It is essential to make the surface of the tip of the ink guide core slightly oversaturated with the ink and connect the ink in the surface of the tip of the core to that in the slit of the penpoint. In the writing instrument employing the penpoint assembly, the rear end of the ink guide core is coupled to an ink suction container housed in the rear portion of a penholder. The ink in the ink suction container cannot be all used for writing, and it is inevitable that 20 to 40% of the ink is left unused in the ink suction container. Since an ink guide core support and a penpoint support are separately formed and the penpoint and the ink guide core are fitted between the ink guide core support and the penpoint support, it is troublesome to assemble them and it is difficult to accurately position them to each other.

SUMMARY OF THE INVENTION

The present invention was made in consideration of the above-mentioned circumstances.

Accordingly, it is an object of the present invention to provide a penpoint assembly which includes a penpoint made of a metal plate such as a thin stainless steel plate and is suitable for a light writing instrument and such that the problems (that the outflow of the ink is not improved in proportion to the increase in the length of the slit. the yield in machining or processing is low due to the mutual non-coincidence of the sheared portions of the penpoint at the writing tip thereof, and the outflow of the ink is not stable) of the above-mentioned conventional penpoint assembly are solved to attain a high productivity, a good writing feeling and a good ink outflow property.

It is another object of the present invention to provide a writing instrument which employs a penpoint assembly provided in accordance with the present invention and gives a light writing touch like a fountain pen and in which a penpoint is attached to a support member integrally formed with an ink flow regulating portion. Ink in an ink storage means is guided to the writing tip of the penpoint through an ink guide core, and the problems of the above-mentioned conventional writing instrument are solved to increase the ratio of use of the ink and reduce the number of the parts of the writing instrument to improve the efficiency and accuracy of assembling of the writing instrument. The support member is an integrally formed member comprising a support portion and the ink flow regulating portion extending from the butt of the support portion. As used herein, "integrally formed" means that the support portion and the ink flow regulating portion are formed homogeneously, that is, they are parts of a single continuous body of material. The flow regulating portion is inserted into the penholder of the writing instrument so that the integrally formed member is held therein. Since the writing section of the writing instrument is inserted into the penholder without using a holding member, not only the assembling property of the writing instrument is good but also the ink flows out in an appropriate quantity from the writing tip of the writing section although an ink suction container made of processed fibers or the like is not provided in the penholder. Since a large amount of the ink is not left unused in the writing the instrument as done in the conventional writing instrument having the ink suction container, the length of effective writing by the former writing instrument is longer. In other words, a large quantity of ink is contained in the ink storage means of the writing instrument and free from a capillary force, so that the length of effective writing by the writing instrument is increased. Since the ink guide core is secured by the reduced-diameter part of the center hole of the ink flow regulating portion so that the connection of the tapered portion of the ink guide core and the bent portion of the penpoint is stably maintained in a prescribed position, the outflow of the ink from the writing tip of the penpoint is stably and appropriately continued. Since the tapered portion of the ink guide core is covered so that the ink is prevented from being evaporated or dried from the tapered portion, the fall in the shade of writing or the stoppage of the outflow of the ink from the writing tip of the penpoint does not occur even when quick writing is performed or an impact or the like is applied to the writing instrument. The ink is thus enabled to flow out in an appropriate quantity from the writing instrument to always perform writing at a constant shade.

DETAILED DESCRIPTION OF THE PREFERRED EMBODIMENTS

Figures 1, 2, 3, 4, 5, 6, 7, 8, 9, 10, 11, 12:
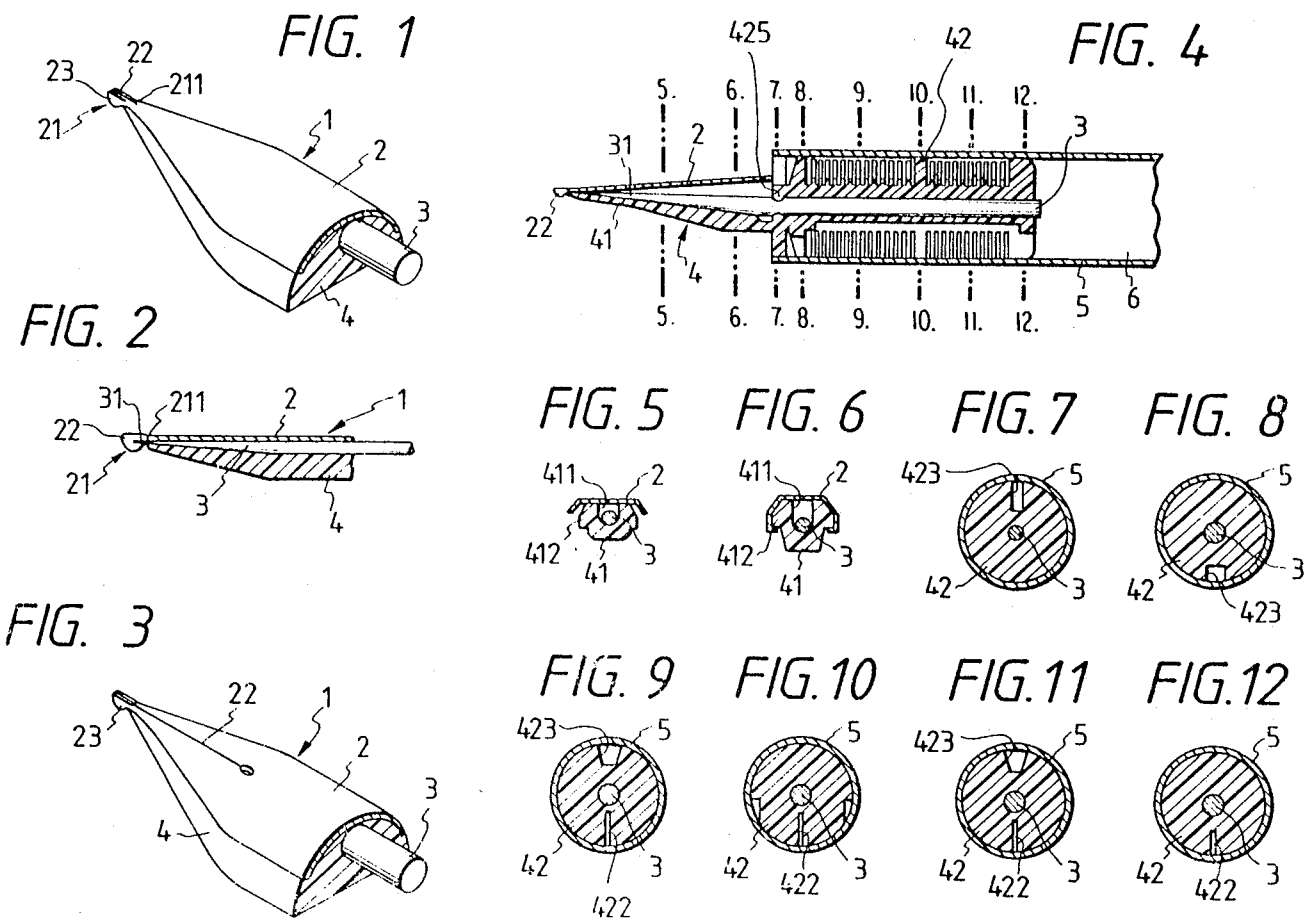
FIG. 1 shows a perspective view of the major part of a penpoint assembly which is an embodiment of the present invention.
FIG. 2 shows a longitudinally sectional view of the major part of the penpoint assembly.
FIG. 3 shows a perspective view of a conventional penpoint assembly.
FIG. 4 shows a longitudinally sectional view of the major part of a writing instrument which is another embodiment of the present invention.
FIG. 5 shows a sectional view of the major part of the writing instrument along a line A—A shown in FIG. 4.
FIG. 6 shows a sectional view of the major part of the writing instrument along a line B—B shown in FIG. 4.
FIG. 7 shows a sectional view of the major part of the writing instrument along a line C—C shown in FIG. 4.
FIG. 8 shows a sectional view of the major part of the writing instrument along a line D—D shown in FIG. 4.
FIG. 9 shows a sectional view of the major part of the writing instrument along a line E—E shown in FIG. 4.
FIG. 10 shows a sectional view of the major part of the writing instrument along a line F—F shown in FIG. 4.
FIG. 11 shows a sectional view of the major part of the writing instrument along a line G—G shown in FIG. 4.
FIG. 12 shows a sectional view of the major part of the writing instrument along a line H—H shown in FIG. 4.

Embodiments of the present invention are hereafter described in detail with reference to the drawings attached hereto.

One of the embodiments is a penpoint assembly 1 comprising a penpoint 2 made of a metal plate and having a slit 22 along the center line thereof, an ink guide core 3 into which ink is introduced from an ink storage means and through which the ink is guided to the slit, and a support member 4 for supporting the ink guide core.

The metal plate constituting the penpoint 2 is cut off at both the side edges thereof as a taper toward the writing tip 21 of the penpoint. The penpoint 2 is bent at the writing tip 21 thereof so that the penpoint has small widths at both sides of the slit 22 and the bent portion 23 of the penpoint surrounds a small space. Since the penpoint 2 should made of an ink-resistant metal plate of appropriate rigidity and elasticity a thin stainless steel plate, plated sheets of various metals and so forth may be used to make the penpoint. The width of the slit 22 is set at such a value of 0.01 to 0.9 mm that it performs a capillary action. The slit 22 is made in the penpoint 2 by conventional cutting or shearing or the like. It is a feature of the present invention that the slit 22 extends from the front end of the tip 21 of the penpoint 2 to the vicinity of the rear end 211 thereof. A thin groove looking like a slit may be provided only in the surface portion of the penpoint 2 or an image looking like a slit may be printed on the surface of the penpoint so that the thin groove or the image extends backward from the rear end 211 of the tip 21 to make the penpoint look like that of a fountain pen or the like.

The ink guide core 3 is made of a material which performs a capillary action and has an appropriate liquid storing property. For example, the ink guide core 3 is made of fibers fixed to each other by a resin or by fuse-bonding, or is made of plastic rod having a capillary opening which extends in the axial direction thereof. The ink guide core 3 is tapered at the tip portion 31 thereof.

The support member 4 supports the penpoint 2 and the ink guide 3. The support member 4 should preferably be made of formed plastic, and may be provided with various forms appropriate for the proper function of the support member.

The guide core 3 is disposed in tight contact with the penpoint 2 under the slit 22 thereof to extend in the axial direction of the penpoint assembly 1. The support member 4 is then fitted to the penpoint 2 and the ink guide core 3 as the tapered tip portion 31 of the ink guide core is inserted in the small space inside the bent portion 23 of the tip 21 of the penpoint. The penpoint assembly 1 is thus constituted.

The operation of the penpoint assembly 1 will now be described. The ink is introduced from the ink storage means into the ink guide core 3 and guided to the tapered tip portion 31 of the core, which is inserted in the small space inside the bent portion 23 of the penpoint 2, so that the tapered tip portion 31 and the vicinity thereof are slightly oversaturated with the ink. The ink then moves into the slit 22 of the penpoint 2 at the writing tip thereof so that the ink is used for writing.

An actual example of the above-described embodiment will now be described. A thin stainless steel plate of 0.25 mm in thickness was cut off to prescribed dimensions and then subjected to shearing so that the slit 22 of 0.02 mm in width and 1.2 mm in length was made in the plate and extended from the front end of the writing tip 21 to the rear end 211 thereof. The plate was thereafter subjected to bending. The penpoint 2 shown in FIGS. 1 and 2 was thus manufactured. The tapered tip portion 31 of the ink guide core 3 made of polyester fibers fixed to each other by a resin and having a porosity of about 60% was inserted into the small space inside the bent portion 23 of the penpoint 2. The support member 4 made of formed plastic was fitted to the penpoint 2 and the ink guide core 3 so that the penpoint assembly 1 was obtained.

For comparison, a slit of 8 mm in length was made in the same kind of thin stainless steel plate so that a conventional penpoint assembly shown in FIG. 3 was obtained. The ratio of defectiveness of the actual examples of the above-described embodiment, which were the penpoint assemblies 1, was compared with that of defectiveness of comparative examples which were the conventional penpoint assemblies. It turned out that the ratio of defectiveness of the actual examples was 0% but that of defectiveness of the comparative examples was 35%. The actual and the comparative examples were nearly equal to each other in the property of ink outflow from the writing tip. The penpoint assembly 1 was attached to the tip of a penholder and coupled to the ink storage means disposed in the rear portion of the penholder and made of bundled fibers, a member provided with an ink regulator (pen core) having comb-like grooves in the outside portion thereof and a through hole in the inner portion thereof along the axis thereof, or another ink storage material or member, so that the penpoint assembly was used for writing.

Figure 13:
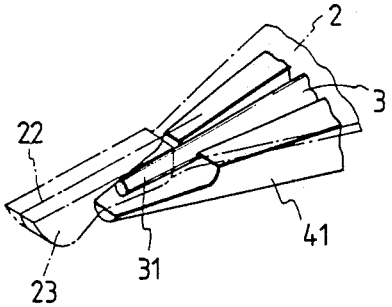
FIG. 13 shows an enlarged view of a concrete example of the writing tip of the penpoint assembly shown in FIG. 1.
Figure 14:
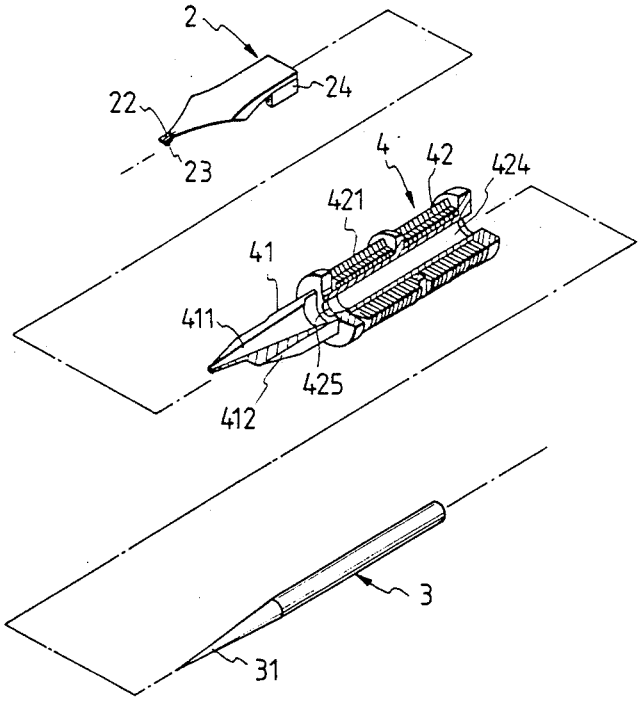
FIG. 14 shows an exploded view of the penpoint assembly shown in FIG. 1.

A writing instrument forming another embodiment of the invention will now be described. As shown in FIGS. 4, 5, 6, 7, 8, 9, 10, 11, 12, 13 and 14, the writing instrument includes a penpoint assembly comprising a penpoint 2, an ink guide core 3 and a support portion 41. The penpoint 2 is made of a metal plate cut off at both the side edges thereof as a taper toward the writing tip of the penpoint and having a slit 22 along the center line of the penpoint at the writing tip thereof, as shown FIGS. 13 and 14. The penpoint 2 is bent at the writing tip thereof so that the penpoint has small widths at both the sides of the slit 22 and the bent portion 23 of the penpoint surrounds a small space, as shown in FIGS. 13 and 14. The ink guide core 3 is disposed under the penpoint 2 and extends in the axial direction of the penpoint assembly, and the tapered portion 31 of the ink guide core is inserted inside the bent portion 23 of the penpoint 2, as shown in FIGS. 13 and 14. The support portion 41 has a guide groove 411 for supporting the ink guide core 3.

The writing instrument has an integrally formed member 4 whose ink flow regulating portion 42 is coupled to the butt of the support portion 41, as shown in FIGS. 4 and 14. Annular comb-like grooves 421, a slit-like ink groove 422 extending in the longitudinal direction of the integrally formed member and intersecting the annular comb-like grooves, and an air exchange groove 423 are provided in the outside of the ink flow regulating portion 42. A center hole 424 extends through the ink flow regulating portion 42 along the axis thereof and communicates with the guide groove 411 of the support portion 41. The integrally formed member 4 is fitted in the front portion of a penholder 5 so that ink in an ink storage means 6 (shown in FIG. 4) in the rear portion of the penholder is supplied to the penpoint assembly. The ink guide core 3 extends through the center hole 424 of the integrally formed member 4 and is supported in the guide groove 411 of the support member 4. The tapered portion 31 of the ink guide core 3 is inserted inside the bent portion 23 of the penpoint 2. The penpoint 2 covers the guide groove 411.

Since the penpoint 2 of the writing instrument should preferably be made of an ink-resistant metal plate of appropriate rigidity and elasticity, a thin stainless steel plate, plated sheets of various metals and so forth may be used to make the penpoint. The slit 22 of the penpoint 2 is made by shearing, cutting or the like, and extends at least from the front end of the bent portion 23 of the penpoint 2 to the rear end of the bent portion along the center line of the penpoint.

The guide groove 411 of the support portion 41 and the center hole 424 of the ink flow regulating portion 42 may be either aligned to each other, or bent to each other at the butt of the support portion to prevent the ink guide core 3 from moving in the axial direction of the writing instrument. Besides, small projections may be provided on the inside surface of the ink flow regulating portion 42 on the center hole 424 thereof to more surely prevent the ink guide core 3 from moving in the axial direction of the writing instrument. or the center hole may be provided with a reduced diameter part 425 to secure the ink guide core. It is preferable to place the reduced-diameter part 425 near the butt of the ink flow regulating portion 42. The reduced-diameter part 425 will hardly deteriorate the ink guiding property of the ink guide core 3 and will be effective to insert the ink guide core or secure it when the core is attached.

The ink flow regulating portion 42 coupled to the support portion 41 serves to prevent the ink from leaking or spouting out due to an excessive ink outflow toward the writing tip of the penpoint assembly when the quantity of the ink in the ink storage means 6 is small or the internal temperature or pressure changes sharply. The width of the slit-like groove 422 is made smaller than the minimum width of the annular comb-like grooves 421 to quickly introduce excess ink into the slit-like ink groove 422 by a strong capillary force to supply the ink to the annular comb-like grooves. The width of the annular comb-like grooves 421 is increased toward the front end of the ink flow regulating portion 42 so that the capillary force of each of the rear annular comb-like grooves is stronger than that of each of the front annular comb-like grooves. For that reason, the ink from the slit-like groove 422 is unlikely to immediately flow into the front annular comb-like grooves 421, and the ink is accumulated gradually from the rear toward the front to retard the arrival of the ink at the foremost annular groove 421 to prevent the ink from leaking or spouting out from the front end of the ink flow regulating portion. The width of each of the annular comb-like grooves 421 is about 0.1 to 1.2 mm and such as to produce a capillary force and provide good machinability or workability. Either the annular comb-like grooves 421 may be made different in width from each other, or the annular comb-like grooves except for the foremost one may be divided into a plurality of groups, in each of which the grooves have the same width but between which the grooves are different in width from each other. Alternatively. widths of the annular comb-like grooves 421 in the groups may gradually increase toward the foremost groove.

Although the air exchange groove 423 is closed at the rear end thereof, the groove communicates at the front end thereof with the external air (refer to FIG. 7).

The integrally formed member 4 is made of a styrol resin or another thermoplastic resin by injection molding.

The ink guide core 3 for guiding the ink from the ink storage means 6 to the writing tip of the penpoint 2 of the writing instrument, is made of a material which can produce a capillary force and has an appropriate liquid storing property. For example, the ink guide core 3 is made of fibers fixed to each other by a resin or by fuse-bonding, a plastic rod having a capillary opening extending in the axial direction of the core, or the like.

An actual example of the above-described writing instrument will now be described. The penpoint 2 was made of a thin stainless steel plate having a thickness of 0.25 mm and cut off to prescribed dimensions. After the slit 22 of 0.02 mm in width and 1.2 mm in length was made in the stainless steel plate along the center line thereof by shearing so that the slit extended backward from the front end of the writing tip of the penpoint 2 in the axial direction thereof, the stainless steel plate was bent at the writing tip so that the penpoint had small widths at both sides of the slit to form a bent portion 23. The stainless steel plate was also bent at both the side edges of the rear portion thereof so that an attaching portion 24 was formed. The integrally formed member 4, whose ink flow regulating portion 42 was integrally coupled to the rear end of the support portion 41, was made of a styrol resin by injection molding. The support portion 41, which had a length of 16 mm and included the guide groove 411 of about 1.5 mm in width, was tapered toward the writing tip of the penpoint 2 and provided with wings 412 at both the sides of the rear part of the support portion. The guide groove 411 extended upward obliquely at an angle of about 7° to the center hole 424 of the ink flow regulating portion 42. The ink flow regulating portion 42 was 22 mm length and 8 mm in outside diameter. The center hole 424 of 1.6 mm in diameter extended through the ink flow regulating portion 42 along the axis thereof, and communicated at the tip of the center hole with the guide groove 411 of the support portion 41. The center hole 424 had the reduced-diameter part 425 which had a diameter of 1.3 mm and was located on the inside surface of the rear section of the ink flow regulating portion 42 so as to secure the ink guide core 3. The annular comb-like grooves 421 were provided in the ink flow regulating portion 42 and divided into a front group of three annular comb-like grooves of 0.3 mm in width each, an intermediate group of ten annular comb-like grooves of 0.2 mm in width each and a rear group of six annular comb-like grooves of 0.18 mm in width each. The slit-like ink groove 422 of 0.15 mm in width extended through the ink flow regulating portion 42 in the longitudinal direction thereof, and intersected the annular comb-like grooves 421. The air exchange groove 423 was provided in the ink flow regulating portion 42 and located opposite the slit-like ink groove 422.

The process of assembling the actual example of the above-described embodiment as the writing instrument is now described. The penpoint 2 was attached to the support portion 41 by causing the attaching portion 24 of the penpoint to pinch the wings 412 of the support portion. The ink guide core 3, which was tapered at the front portion 31 thereof and made of bundled polyester fibers fixed to each other by a resin and had a porosity of about 60% an outside diameter of 1.5 mm and a length of 38 mm, was inserted into the center hole 424 of the ink flow regulating portion 42 from the rear end thereof and then into the guide groove 411 of the support portion 41 so that the tip of the tapered front portion 31 was located inside the bent portion 23 of the penpoint 2 to supply the ink into the slit 22 thereof. The penpoint assembly was thus obtained. The ink flow regulating portion 42 of the penpoint assembly was inserted into the penholder 5 of about 10 cm in length and 8 mm inside diameter. A cap not shown in the drawings was fitted on the penholder 5. The writing instrument was thus constituted. The ink storage means 6 was provided in the penholder 5 after the ink storage means was filled with ink which was aqueous and 1.5 mPa/s in viscosity and 50 mN/m in surface tension.

What is claimed is:

1. A writing instrument comprising;

a penpoint assembly including a metal penpoint tapered toward the writing tip thereof and provided with a slit extending in said writing tip along the center line in the longitudinal direction of said penpoint, said penpoint having a bent portion of the writing tip formed of small bent projections at both sides of said slit, an ink guide core extending under said slit in the axial direction of said penpoint assembly and communicating at the tip of said core with said slit, and a support member having a guide groove for supporting said core, wherein said slit extends at least from the front end of said writing tip to the vicinity of the rear end thereof, and said support member is an integrally formed member which comprises a support portion and an ink flow regulating portion extending from the butt of said support portion;

a penholder having in the rear portion thereof an ink storage means and in the front portion thereof means for receiving said support member whereby ink in said ink storage is guided to said writing tip, said support member further comprising annular comb-like grooves, a slit-like ink groove extending in the longitudinal direction of said ink flow regulating portion and intersecting said annular comb-like grooves and an air exchange groove in said ink flow regulating portion, a center hole communicating with said guide groove extending through said ink flow regulating portion extending along the axis thereof to receive said ink guide core being supported in said guide groove and being secured by small projections provided on an inside wall of said center hole or by a reduced-diameter part of said center hole so that the tapered portion of said core is inserted into said bent portion and said penpoint covers said guide groove.

2. A writing instrument according to claim 1, wherein the guide groove of the support portion and the center hole of the ink flow regulating portion are bent to each other at the butt of said support portion.

3. A writing instrument according to claim 1, wherein the tip of the support portion extends toward said writing tip over the tip of the tapered portion of said ink guide core inserted into said bent portion, and covers the lower surface of the mutually-facing sides of the rear part of the bent portion of the penpoint.

4. A writing instrument according to claim 1, wherein the rear portion of the penpoint is bent at both side edges and secured to the support portion of said support member.

* * * * *